US005969440A

United States Patent [19]

Young et al.

[11] Patent Number: 5,969,440

[45] Date of Patent: Oct. 19, 1999

[54] PUSH BAR WITH REDUNDANT PRESSURE SENSORS AND FAIL SAFE MECHANICAL SWITCH

[76] Inventors: Christopher L. Young, 1339 Alessandro Dr., Newbury Park, Calif. 91321; Richard Geringer, 12628 Ambermeadow St., Moorpark, Calif. 93021; David Geringer, 28364 Balkin, Agoura, Calif. 91301

[21] Appl. No.: 09/040,468

[22] Filed: Mar. 18, 1998

[51] Int. Cl.[6] ..... E05B 47/00

[52] U.S. Cl. ..... 307/119; 70/271; 70/432; 292/92; 340/545

[58] Field of Search ..... 307/119; 70/271, 70/266, 92, 432; 292/92; 340/542, 545, 549, 528

[56] References Cited

U.S. PATENT DOCUMENTS

| | | | |
|---|---|---|---|
| 3,576,119 | 4/1971 | Harris | 70/271 |
| 4,006,471 | 2/1977 | Pappas | 292/92 |
| 4,257,631 | 3/1981 | Logan | 292/251.5 |
| 4,328,985 | 5/1982 | Logan | 292/201 |
| 4,354,699 | 10/1982 | Logan | 292/201 |
| 4,652,028 | 3/1987 | Logan et al. | 292/251.5 |
| 4,720,128 | 1/1988 | Logan et al. | 292/251.5 |
| 5,169,185 | 12/1992 | Slaybaugh et al. | 292/92 |
| 5,340,171 | 8/1994 | Slaybaugh et al. | 292/92 |
| 5,429,399 | 7/1995 | Geringer et al. | 292/92 |

*Primary Examiner*—Albert W. Paladini
*Attorney, Agent, or Firm*—John J. Posta, Jr.

[57] ABSTRACT

An improved pressure-actuated door access bar is disclosed which may be located on a door to control access or egress through the door, whereby the door access bar is used to trigger unlocking or opening, or both unlocking and opening, of the door following pressure being exerted on the door access bar by an individual desiring access or egress through the door. Two electromechanical force transducer assemblies having no moving parts are mounted within a rigid base member which may in turn be mounted on a door or in another desired location, and a cover member mounted over the base member exerts pressure on the electromechanical force transducer assemblies when pressure is placed on it. When a given amount of pressure is detected by either or both of the electromechanical force transducer assemblies, the door will be unlocked or opened, or both unlocked and opened. A redundant emergency switch is also located in the door access bar of the present invention, and will operate in a fail-safe manner to unlock the door in the event of a failure of one or both of the electromechanical force transducer assemblies upon detection of a greater amount of force being exerted upon the cover member.

29 Claims, 5 Drawing Sheets

FIG. 1
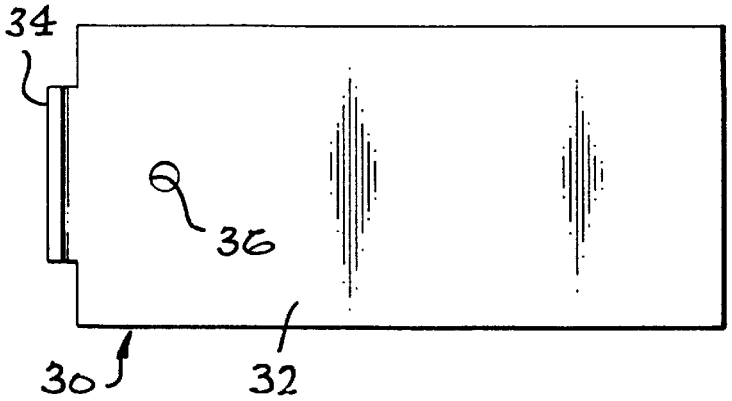
FIG. 2
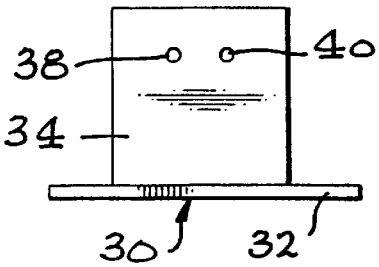
FIG. 3
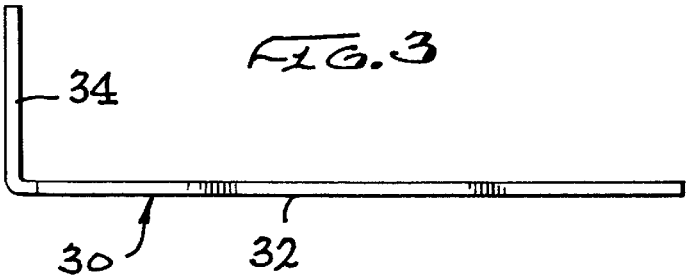
FIG. 4
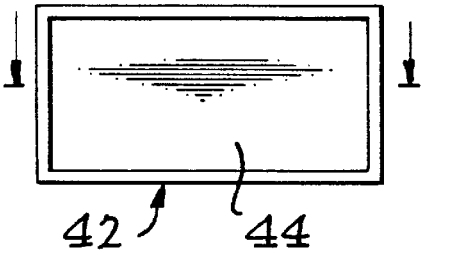
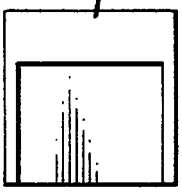
FIG. 5
FIG. 6
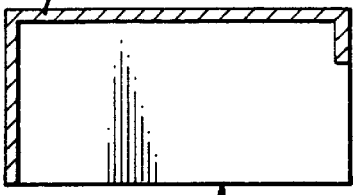
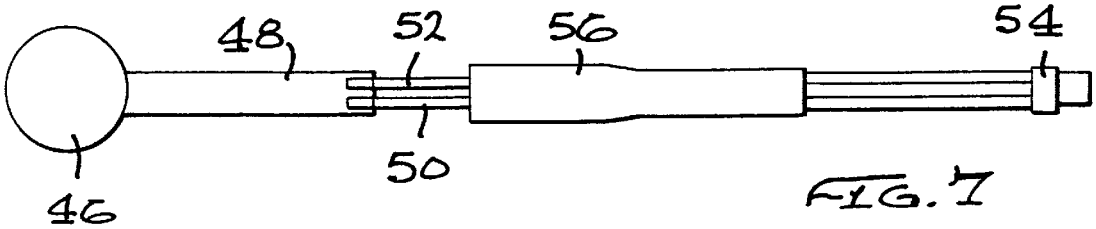
FIG. 7
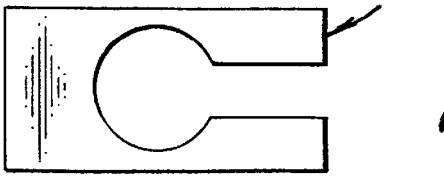
FIG. 8

44
42
66
62
58
46
48
56
68
50
52
54
60
80
72
70
84
78
64
82
74
32
76
38
30
40
34
36

FIG. 15
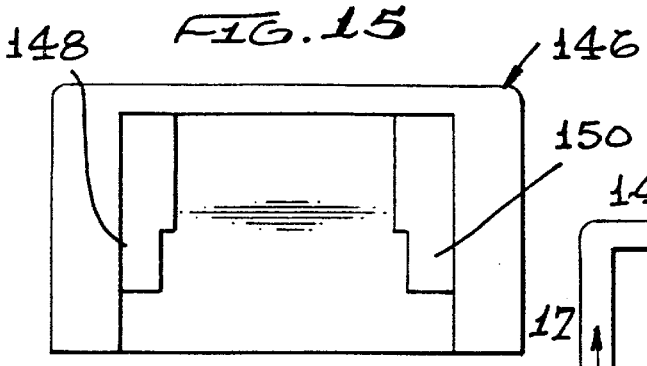
FIG. 16
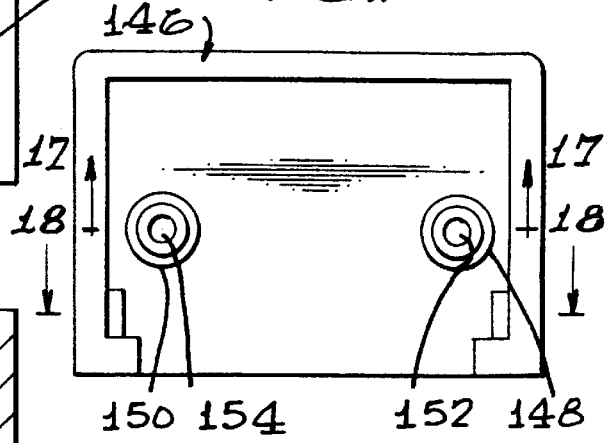
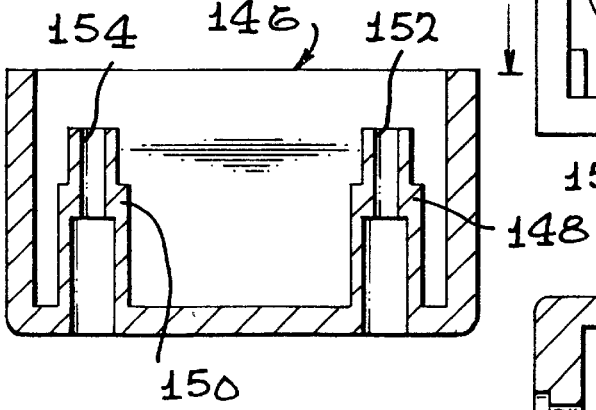
FIG. 17
FIG. 18
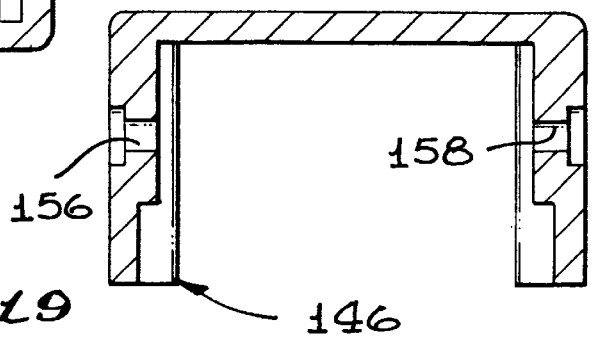
FIG. 19
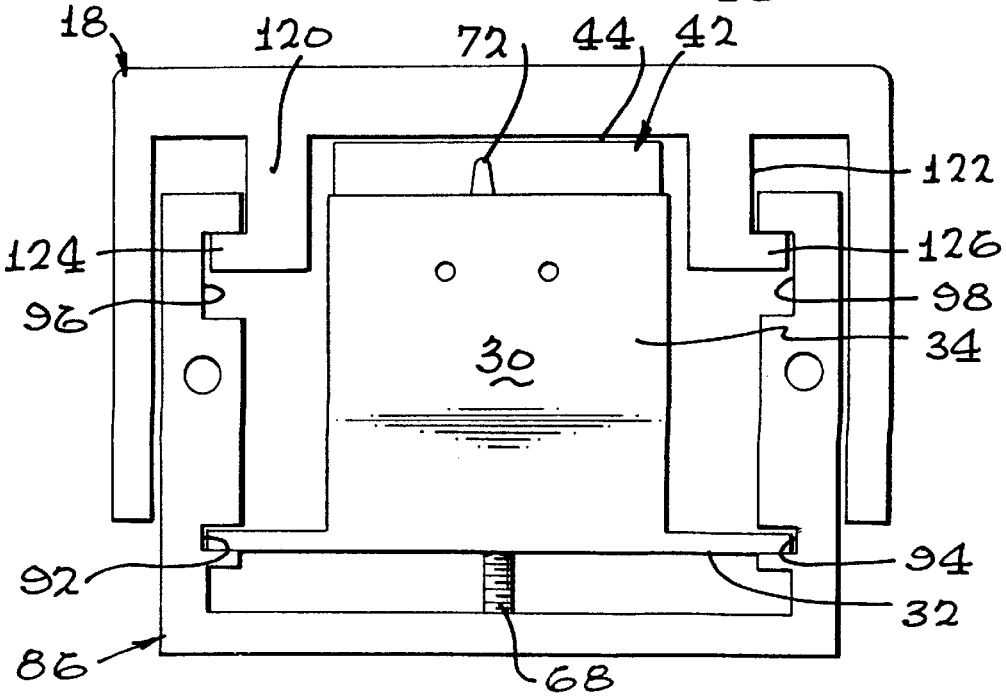

PUSH BAR WITH REDUNDANT PRESSURE SENSORS AND FAIL SAFE MECHANICAL SWITCH

BACKGROUND OF THE INVENTION

Field of the Invention

The present invention relates generally to electrically operated door access systems in which the door is either unlocked or opened, or both unlocked and opened, by accessing an electronic control system, and more particularly to an improved pressure-actuated door access bar which may be located on a door through which access is controlled by the electrically operated door access system, whereby the pressure-actuated door access bar is used to trigger unlocking or opening, or both unlocking and opening, of the door following pressure being exerted on the pressure-actuated door access bar by an individual desiring access or egress through the door.

Hardware and systems for controlling egress and access through doors may predominantly be classified into one of two categories. The first category is that of hardware and systems which are designed to limit and control egress and access through doors. Devices falling into this classification are generally utilized for theft-prevention or to establish a secured area into which (or from which) entry is limited. The second category is that of hardware and systems which are designed to facilitate access through doors by opening the doors in a manner not requiring great strength or facility by the person desiring access. Devices falling into this second classification are used to automate the opening of a door in an easy, yet controlled, manner suitable for use by handicapped individuals, for example.

The first of these two categories includes controlled access security doors and operating systems for such doors. Such doors and systems have evolved over the years from simple doors having heavy duty mechanical locks thereon to sophisticated egress and access control devices. In bygone times, heavy duty chains and locks were the norm on security doors which were not generally used, or which were used to prevent theft or vandalism. However, fire codes have made such relatively simple door locking systems obsolete, at least in most developed countries. Emergency exit doors are required by law to be provided in all commercial buildings, and such doors must be operative in the event of a fire, earthquake, or other emergency.

These exit doors are typically provided with heavy horizontal push bars, which unlock the door upon actuation and which may provide an alarm of some sort. The early alarms on such doors were either mechanical in nature, such as wind-up alarms contained on the push bar mechanism, or completely separate electrical circuits actuated by a switch opened as the door was opened. Accordingly, egress from such doors was immediate, and, although egress was accompanied by an alarm, typically the person leaving through the door was long gone by the time security personnel arrived.

Many stores suffer great losses through emergency doors, with thieves escaping cleanly through the emergency doors with valuable merchandise. In addition, industrial companies also suffer pilferage of valuable equipment and merchandise through such emergency exit doors. While one solution is to have a greater number of security personnel patrolling the emergency exit doors, to do so is also an expensive solution.

As might be expected, the art reflects a number of emergency exit access activation devices which attempt to solve this problem. A first type of device is found in U.S. Pat. No. 4,257,631, to Logan, Jr., which describes a system activated by a push bar which, upon depression, moves a switch carried by the door to sound an alarm and start a timer delay. After the delay, the door is unlocked.

This type of device in which a push bar containing an electrical switch therein is used to initiate a request for access or egress is by far the most common. It has not always been viewed as the optimum solution, however, due to the difficulty in making it durable and long lasting in addition to being relatively simple and inexpensive. Several other types of systems have been proposed, and, although none of these systems has found great acceptance, a brief discussion of them is in order.

U.S. Pat. No. 4,328,985 and U.S. Pat. No. 4,354,699, both also to Logan, teach a hydraulic system for accomplishing the delay prior to unlocking the door, and a retrofit locking device of the same type which is usable with any door latching system, respectively. These two systems are thus mechanical rather than electrical in nature.

U.S. Pat. No. 4,652,028 and U.S. Pat. No. 4,720,128, to Logan et al. and to Logan, Jr., et al., respectively, teach an electromagnet mounted on a door jamb, an armature on the door held by the electromagnet to retain the door in the closed position, and a switch mounted near the electromagnet which is used to indicate when the door is being opened or tampered with. The Logan, Jr. et al. '128 patent also adds a set of contacts to confirm that the armature properly contacts the electromagnet. These systems have no switch located in a door access bar.

As mentioned above, the second category of hardware and systems includes devices and systems which are designed to facilitate access through doors by opening the doors in a manner not requiring great strength or facility by the person desiring access. One example of such a device is the type of door commonly found in supermarkets, which is typically radar controlled. Another example is a power actuated door in a hospital corridor, wherein when a wall switch is depressed the door automatically opens.

Both of the two categories of devices discussed above are beneficial, yet both categories of devices still possess several disadvantages and are illustrative of problems inherent in the art. For example, the preferred type of door access bar, the type containing an electrical switch therein, has several disadvantages. First, in order for the switching mechanism to operate, there must be a minimal amount of free movement in the bar. The use of a limit switch in the bar requires the switch to be precisely adjusted to operate properly. In addition, one or more springs must be utilized in order to keep the switches in the open position when the door access bar is not being depressed. In addition, typical electrical switch type door access bars are mechanically fairly complex, and are not inexpensive to manufacture.

A substantially improved door access bar is illustrated in U.S. Pat. No. 5,564,228, to Geringer et al. The improved door access bar of the Geringer et al. '228 patent contains an electromechanical mechanism through which mechanical contact by a user with the door access bar is translated into an electrical output, which may be utilized to initiate the process of unlocking the door on which the door access bar is mounted. The transducer used by the door access bar of the Geringer et al. '228 patent is a force sensing resistor (FSR), which has a resistance which drops when a compressive force exerted across the force sensing resistor increases.

The FSR transducer is placed in series with a reference resistor having a fixed resistance, with a constant voltage being placed across the FSR and the reference resistor. As an increasing amount of force is applied to the FSR, its resistance drops, leaving a larger portion of the voltage across the reference resistor. A comparator having a predetermined reference voltage provides an electrical output when a predetermined amount of force is applied to the door access bar, with the electrical output from the comparator being used to open the door. The amount of force needed to be applied to the sensor bar to trigger an output from the comparator may be adjusted by varying the reference voltage.

The door access bar of the Geringer et al. '228 patent contained two FSR's, one mounted in the door mounting hardware located at each end of the door access bar. When the predetermined pressure was exerted on either FSR, the circuitry of the Geringer et al. '228 patent caused the door to be opened. The door access bar of the Geringer et al. '228 patent represented a substantial improvement over the prior art, and has met with considerable commercial success, and U.S. Pat. No. 5,564,228, to Geringer et al., is hereby incorporated herein by reference.

The use of the door access bar of the Geringer et al. '228 patent on a large number of doors has presented a rather unusual problem which may cause unintended switching operation of the door access bar. When the door access bar of the Geringer et al. '228 patent is mounted on a door which is warped, or which becomes warped after the door access bar is mounted thereon, a slight twisting in one of the mounting members of the door access bar may exert pressure on one of the FSR's, causing the door to unlock. This results in a service call in which the door access bar must be recalibrated to compensate for the increased pressure on the FSR. In some extreme situations, the door will become warped to such an extent that the door access bar will no longer properly operate. The same problem presents itself in the case of sagging doors, as well as in tweaked glass stiles.

Accordingly, it is accordingly the primary objective of the present invention that it present a door access bar having an improved mounting arrangement for electromechanical force transducers through which mechanical contact by a user with the door access bar is translated into an electrical output which may be utilized to initiate the process of unlocking the door on which the door access bar is located. It is a directly related objective of the door access bar of the present invention that it contain the electromechanical force transducers entirely within the door access bar itself, and not between the door access bar and its mounting mechanism, thereby obviating inappropriate force sensing problems associated with warping or sagging of the door the door access bar is mounted on. It is another objective of the door access bar of the present invention that it have redundant electromechanical force transducers to ensure that pressure exerted on the door access bar is reliably sensed, with either force sensor being sufficient to trigger operation of the door access bar to cause the door to be unlocked and/or opened.

It is a further objective of the door access bar of the present invention that it require only a slight degree of force and minimal movement of the door access bar to initiate the electrical output indicating a desire for access or egress, and that the minimum amount of force required to initiate opening of the door be fully adjustable over an appreciable range. It is still another objective of the door access bar of the present invention that it include an emergency override switch which will operate to open the door even if both of the electromechanical force transducers or the control circuitry were to fail. It is a related objective of the door access bar of the present invention that the emergency override switch be operated by the same motion exerted on the door access bar that normally causes the electromechanical force transducers to unlock and/or open the door. It is yet another objective of the door access bar of the present invention that it be both easy and quick to mount on any door or other desired location.

The door access bar of the present invention must be of a construction which is both durable and long lasting, and it should also require little or no maintenance to be provided by the user throughout its operating lifetime. In order to enhance the market appeal of the door access bar of the present invention, it should also be of inexpensive construction to thereby afford it the broadest possible market. Finally, it is also an objective that all of the aforesaid advantages and objectives of the apparatus of the door access bar of the present invention be achieved without incurring any substantial relative disadvantage.

SUMMARY OF THE INVENTION

The disadvantages and limitations of the background art discussed above are overcome by the present invention. With this invention, two force sensing resistor (FSR) electromechanical force transducers are utilized in a door access bar designed to be mounted on a door or in another desired location. In the preferred embodiment, a heavy duty metal base rail is mounted onto a door using mounting plates located at each end thereof. Two electromechanical force transducer assemblies are mounted entirely within the base rail, together with a circuit board containing the control circuitry for the electromechanical force transducer assemblies. The circuit board is electrically connected to the two electromechanical force transducer assemblies and to a source of power. A metal touch pad cover is mounted onto the base rail, and is retained in place by end caps located at each end of the base rail.

The electromechanical force transducer assemblies are located adjacent opposite ends of the base rail, with the circuit board being located intermediate the electromechanical force transducer assemblies within the base rail. Each of the electromechanical force transducer assemblies is supported from a base plate which is fixedly mounted inside the base rail. An FSR is located inside a "sandwich" of resilient foam material.

FSR's typically are made of two polymer sheets which are laminated together, with one of the sheets being coated with interdigitating electrodes and the other sheet being coated with semiconductive material. When force is applied to the FSR, the semiconductive material shunts the interdigitating electrodes to a greater or lesser degree. In the preferred embodiment, one side of the FSR is adhesively mounted onto a thin plate, with a resilient silicone rubber disc being located onto the other side of the FSR. This assembly is placed between two segments of resilient foam material, with a gasket member made of elastomeric material located around the periphery of the FSR being adhesively secured to both of the segments of resilient foam material. The bottom of this "sandwich" is adhesively secured to the base plate, and a cover member is adhesively secured over the "sandwich." Importantly, the cover member is spaced away from the base plate, allowing the "sandwich" to be compressed when force is exerted onto the top of the cover member.

When the touch pad cover is placed on the base rail, it can move a short distance between first and second positions respectively away from and toward the interior of the base rail. When the touch pad cover is in its first position (furthest away from the interior of the base rail), the cover member of each of the electromechanical force transducer assemblies is located against the interior of the touch pad rail, with the "sandwich" not being compressed. As pressure is placed on the touch pad cover, it tends to immediately compress the "sandwich" in each of the electromechanical force transducer assemblies.

Well before the touch pad cover moves to its second position, more than sufficient pressure is placed on one or both of the FSR's in the two electromechanical force transducer assemblies to cause the control circuitry to provide an electrical output which may be utilized to initiate the process of unlocking the door on which the door access bar is located. By adjusting a reference signal on the circuit board, more or less pressure may be required to initiate an output which will unlock the door. Typically, between five and fifteen pounds of pressure may be required.

In a departure from previously known access devices and systems, the door access bar of the present invention includes an emergency switch which may be automatically activated merely by putting additional pressure on the touch pad cover. In the preferred embodiment, a microswitch is mounted onto one of the electromechanical force transducer assemblies. In accordance with this scheme, the base plate is L-shaped, with a segment (the base of the L) extending upward and oriented outwardly from the interior of the base rail. A microswitch is mounted on this segment of the base plate, with its actuator being oriented outwardly from the interior of the base rail.

When the touch pad cover moves nearly all the way from its first position to its second position, the actuator of the microswitch will be depressed, causing an electrical output which may be utilized to initiate the process of unlocking the door on which the door access bar is located (if it has not already been unlocked by the operation of the electromechanical force transducer assemblies). In the preferred embodiment, the pressure necessary to actuate the microswitch is greater than the pressure necessary to actuate the electromechanical force transducer assemblies. Typically, not less than fifteen pounds of pressure on the touch pad cover is necessary to move it sufficiently far to actuate the microswitch. It will be at once appreciated by those skilled in the art that the emergency switch works with the same motion (caused by the application of force onto the touch pad cover) which places compressive force on the electromechanical force transducer assemblies. Thus, the emergency switch operates without requiring that the user have prior knowledge of the existence of the emergency switch, and without the user having to find a concealed emergency switch as was required in past devices.

It may therefore be seen that the present invention teaches a door access bar having an improved mounting arrangement for electromechanical force transducers through which mechanical contact by a user with the door access bar is translated into an electrical output which may be utilized to initiate the process of unlocking the door on which the door access bar is located. The door access bar of the present invention contains the electromechanical force transducers entirely within the door access bar itself, and not between the door access bar and its mounting mechanism, thereby obviating inappropriate force sensing problems associated with warping or sagging of the door the door access bar is mounted on. The door access bar of the present invention has redundant electromechanical force transducers to ensure that pressure exerted on the door access bar is reliably sensed, with either force sensor being sufficient to trigger operation of the door access bar to cause the door to be unlocked and/or opened.

The door access bar of the present invention requires only a slight degree of force and minimal movement of the door access bar to initiate the electrical output indicating a desire for access or egress, and the minimum amount of force required to initiate opening of the door is fully adjustable over an appreciable range. The door access bar of the present invention includes an emergency override switch which will operate to open the door even in the event that both of the electromechanical force transducers or the control circuitry were to fail. The emergency override switch is operated by the same motion exerted on the door access bar that normally causes the electromechanical force transducers to unlock and/or open the door. The door access bar of the present invention is both easy and quick to mount on any door or other desired location.

The door access bar of the present invention is of a construction which is both durable and long lasting, and which will require little or no maintenance to be provided by the user throughout its operating lifetime. The door access bar of the present invention is also of inexpensive construction to enhance its market appeal and to thereby afford it the broadest possible market. Finally, all of the aforesaid advantages and objectives of the apparatus of the door access bar of the present invention are achieved without incurring any substantial relative disadvantage.

DESCRIPTION OF THE DRAWINGS

These and other advantages of the present invention are best understood with reference to the drawings, in which:

FIG. 1 is a top plan view of a base plate for an electromechanical force transducer assembly constructed according to the teachings of the present invention, showing a threaded aperture located therein;

FIG. 2 is a side view of the base plate illustrated in FIG. 1, showing the L-shaped configuration of the base plate and an upwardly extending side of the base plate (the base of the L);

FIG. 3 is an end view of the base plate illustrated in FIGS. 1 and 2, showing two threaded apertures located in the upwardly extending side of the base plate (the base of the L);

FIG. 4 is a bottom plan view of a cover member for the electromechanical force transducer assembly of the present invention, showing that the bottom of the cover member is open;

FIG. 5 is an end view of the cover member illustrated in FIG. 4, showing that the lower portion of the end of the cover member illustrated in FIG. 5 is open;

FIG. 6 is a cross sectional view of the cover member illustrated in FIGS. 4 and 5, showing that the interior of the cover member is empty;

FIG. 7 is a plan view of a disc-shaped force sensing resistor (FSR) having a conductor-carrying segment extending therefrom, showing wires connected to the conductors of the FSR with a connector located at the distal end of the wires, and also showing an insulating sheath for placement over the distal end of the conductor-carrying segment of the FSR and the proximal ends of the wires;

FIG. 8 is a plan view of a gasket member made of elastomeric material having a generally rectangular configuration with a portion cut away to admit the FSR illustrated in FIG. 7 therein, the gasket member thereby conforming to the periphery of the FSR;

FIG. 15 is a bottom plan view of an end cap for installation onto an end of the base rail illustrated in FIGS. 10 and 11 after the touch pad cover illustrated in FIG. 12 is installed thereon;

FIG. 16 is an inside view of the end cap illustrated in FIG. 15, showing two mounting posts located therein for use in attaching the end cap to the base rail illustrated in FIGS. 10 and 11;

FIG. 17 is a first cross sectional view of the end cap illustrated in FIGS. 15 and 16, showing the configuration of the mounting posts located therein;

FIG. 18 is a second cross sectional view of the end cap illustrated in FIGS. 15 through 17, showing two apertures located therein for use in attaching the end cap to the mounting plate illustrated in FIGS. 13 and 14;

FIG. 19 is an end view of the touch pad cover illustrated in FIG. 12 installed onto the base rail illustrated in FIGS. 10 and 11, showing the close location of the interior of touch pad cover to the top of one of the electromechanical force transducer assemblies, and also showing the microswitch actuator.

DETAILED DESCRIPTION OF THE PREFERRED EMBODIMENT

Figure 9:
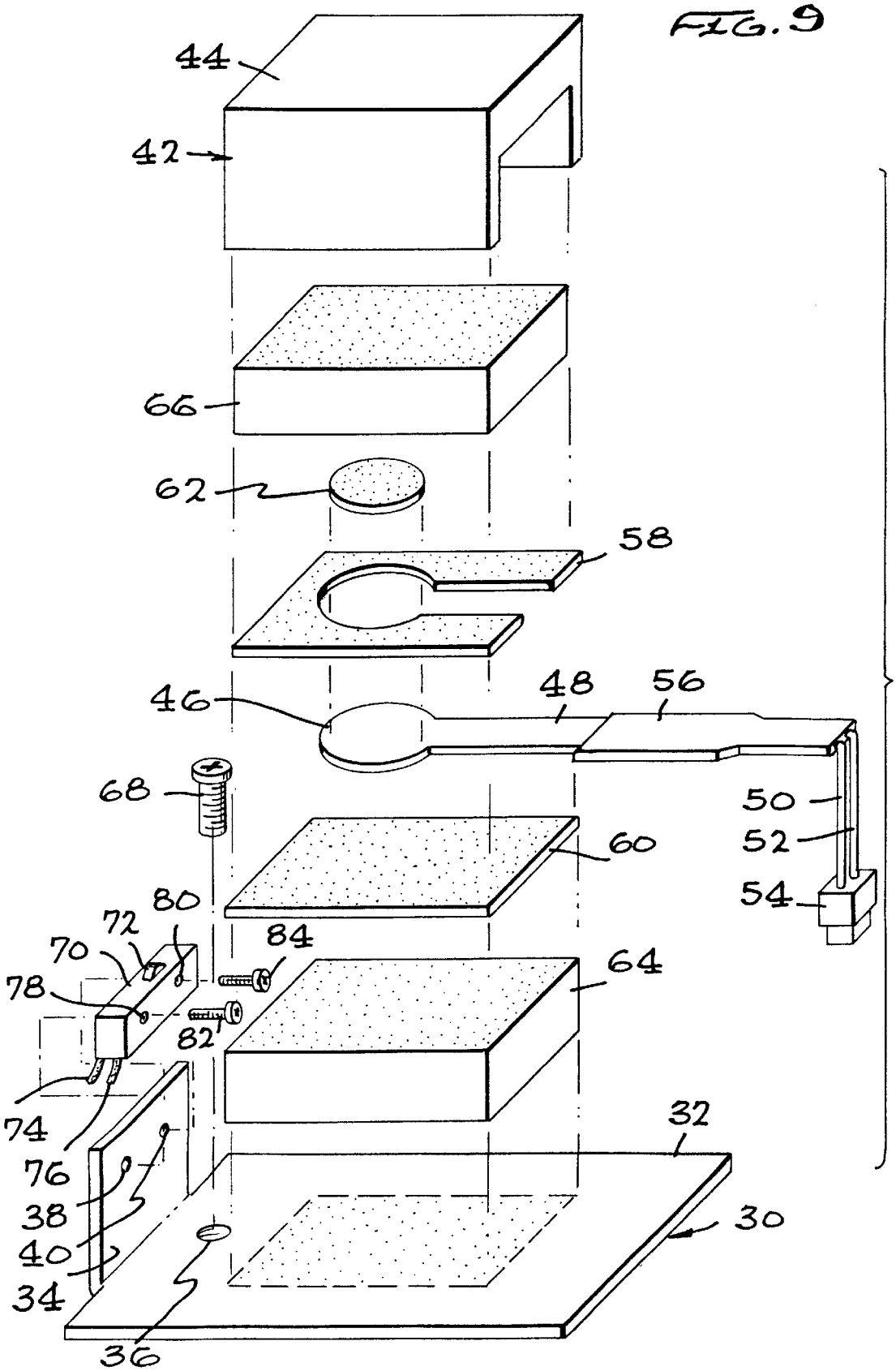
FIG. 9 is an isometric view of the assembly of an electromechanical force transducer assembly using the base plate illustrated in FIGS. 1 through 3, the cover member illustrated in FIGS. 4 through 6, the FSR illustrated in FIG. 7, and the gasket member illustrated in FIG. 8, and also showing two segments of resilient foam material which are located respectively above and below the FSR, a thin plate located immediately below the FSR, and a silicone rubber disc located immediately above the FSR, and also showing a microswitch which may optionally be mounted on the upwardly extending side of the base plate (the base of the L)

The preferred embodiment of the present invention is embodied in a door access bar which may be used as the means to request access or egress through a door on which the door access bar is located, which door is locked by an electrically-operated lock of conventional design. When the door access bar is pressed, control circuitry contained within the door access bar provides an electrical output signal indicating that access or egress through the door is being requested. The door access bar of the present invention uses a base rail which is mounted on the door or other desired location as the frame onto which the other components of the device are mounted. These components include two electromechanical force transducer assemblies, which are mounted adjacent opposite ends of the base rail; the construction of these electromechanical force transducer assemblies will be discussed first.

Referring to FIGS. 1 through 3, a base plate 30 is illustrated which is L-shaped (as is most evident in FIG. 3). The base plate has a flat, generally rectangular base portion 32 (the leg of the L), with an upwardly extending, orthogonally oriented side portion 34 (the base of the L). The side portion 34 of the base plate 30 is somewhat narrower than the width of the base portion 32 of the base plate 30.

A threaded aperture 36 is located in the base portion 32 of the base plate 30, at a location which is near to (but spaced away from) the point of connection of the side portion 34 of the base plate 30 to the base portion 32 of the base plate 30. The threaded aperture 36 is centrally located intermediate the longer sides of the base portion 32 of the base plate 30. Located in the side portion 34 of the base plate 30 nearer the top than the bottom thereof are two spaced-apart threaded apertures 38 and 40.

Referring next to FIGS. 4 through 6, a cover member 42 is illustrated which is of a generally box-like configuration. The cover member 42 is entirely open on the bottom thereof, and has a top side 44 which is of a rectangular configuration. The cover member 42 has an end thereof which is closed at the top (adjacent the top side 44 of the cover member 42), and open at the bottom (as best illustrated in FIGS. 5 and 6). In the preferred embodiment, the cover member 42 is made of metal, is relatively thin (although not easily bent), and is approximately one inch wide, one inch high, and two inches long.

Referring now to FIG. 7, a disc-shaped force sensing resistor (FSR) 46 is illustrated which has a conductor-carrying segment 48 extending therefrom. Two wires 50 and 52 are electrically connected at proximal ends thereof to the two conductors in the conductor-carrying segment 48 of the FSR 46. The distal ends of the wires 50 and 52 are electrically connected to a connector 54. An insulating sheath 56 which is shown as being located over the wires 50 and 52 is slid onto the distal end of the conductor-carrying segment 48 of the FSR 46, and continues to cover the proximal portions of the wires 50 and 52.

The FSR 46 is a device which decreases its resistance when an increasing compressive force is applied to it. The FSR 46 is preferably a device such as the model number 302B force sensing resistor, which is available from Interlink Electronics. In the preferred embodiment, the FSR 46 is approximately three-quarters of an inch in diameter.

Referring next to FIG. 8, a gasket member 58 is illustrated which is made of elastomeric material, and which is of a generally rectangular configuration and of a size to fit inside the cover member 42 (which is illustrated in FIG. 4). A portion of the rectangular configuration of the gasket member 58 is cut away to admit the FSR 46 and its conductor-carrying segment 48 (which is illustrated in FIG. 7) therein. Thus, it may be seen that the gasket member 58 will conform to the periphery of the FSR 46 and its conductor-carrying segment 48, without overlaying any portion of the FSR 46.

Referring now to FIG. 9, the assembly of the aforementioned components and other components to be described below into an electromechanical force transducer assembly is illustrated. The FSR 46 is supported on top of a thin plate 60, which is of a rectangular configuration and which is of a size to fit inside the cover member 42. In the preferred embodiment, the thin plate 60 is made of metal.

The FSR 46 is secured to the thin plate 60 using adhesive, which is shown to cover the top surface of the thin plate 60. The FSR 46 is centrally located on the top surface of the thin plate 60. The gasket member 58 is also adhesively secured to the top surface of the thin plate 60, and surrounds the FSR 46 and the conductor-carrying segment 48 of the FSR 46 in a way such that the gasket member 58 does not cover or overlay the FSR 46 or the conductor-carrying segment 48 of the FSR 46 in any place.

A thin disc 62 is located over the top of the FSR 46, and is of a size to cover most of the FSR 46, but not to extend beyond the periphery of the FSR 46. In the preferred embodiment, the thin disc 62 is made of resilient silicone rubber, and is approximately one-sixteenth of an inch in thickness. The thin disc 62 functions as a spring.

The assembly consisting of the FSR 46 (and the conductor-carrying segment 48 of the FSR 46), the thin plate 60, and the thin disc 62 is then sandwiched between two layers of resilient foam material. A first segment of resilient foam material 64 is located beneath the bottom side of the thin plate 60. The top side of the first segment of resilient foam material 64 is coated with adhesive as illustrated. A second segment of resilient foam material 66 is located above the top sides of the gasket member 58 and the thin disc 62. The top sides of the gasket member 58 and the thin disc 62 are coated with adhesive as illustrated.

The first and second segments of resilient foam material 64 and 66 are both of a rectangular configuration which is of a peripheral size to fit inside the cover member 42. The top side of the second segment of resilient foam material 66 is coated with adhesive as illustrated, and the entire sandwich is inserted into the interior of the cover member 42 from the bottom side thereof. An area the size of the bottom of the first segment of resilient foam material 64 on the top surface of the base portion 32 of the base plate 30 is coated with adhesive as illustrated, and the first segment of resilient foam material 64 is then adhesively secured to the base portion 32 of the base plate 30.

Thus, it will be appreciated by those skilled in the art that the FSR 46 is encapsulated in the sandwich of materials above the base plate 30 and underneath the top side 44 of the cover member 42. The first and second segments of resilient foam material 64 and 66 are sufficiently thick that the bottom edges of the cover member 42 are spaced away from the top surface of the base portion 32 of the base plate 30. In the preferred embodiment, the first and second segments of resilient foam material 64 and 66 are made of microcellular urethane such as Poron, which is made by Rogers Corporation.

When pressure is placed on the top side 44 of the cover member 42, the first and second segments of resilient foam material 64 and 66 will compress, and compressive force will be applied to the FSR 46. The first and second segments of resilient foam material 64 and 66 should be sufficiently thick so that at least approximately fifteen pounds of pressure may be placed on the top of the top side 44 of the cover member 42 without having the bottom edges of the cover member 42 contact the top side of the base portion 32 of the base plate 30. At greater pressures, the bottom edges of the cover member 42 will contact the top side of the base portion 32 of the base plate 30, thereby limiting the amount of force which may be applied to the FSR 46.

A screw 68 is threaded into the threaded aperture 36 in the base portion 32 of the base plate 30. The screw 68 will be used to retain the electromechanical force transducer assembly illustrated in FIG. 9 in place in the base rail (not illustrated in FIG. 9).

The electromechanical force transducer assembly illustrated in FIG. 9 optionally may have a microswitch 70 mounted thereon. The microswitch 70 has an actuator 72 located on the top side thereof, and wires 74 and 76 extending therefrom. The microswitch 70 also has two apertures 78 and 80 extending therethrough for use in mounting the microswitch 70. Two screws 82 and 84 extend through the apertures 78 and 80, respectively, in the microswitch 70 and are screwed into the threaded apertures 38 and 40, respectively, in the side portion 34 of the base plate 30. The actuator 72 of the microswitch 70 extends slightly above the top edge of the side portion 34 of the base plate 30.

The door access bar of the present invention utilizes two electromechanical force transducer assemblies. Only one of the electromechanical force transducer assemblies will include the microswitch 70. The microswitch 70 is used as an emergency switch, and its actuation will be described below in conjunction with the discussion of FIG. 19.

Figure 10:
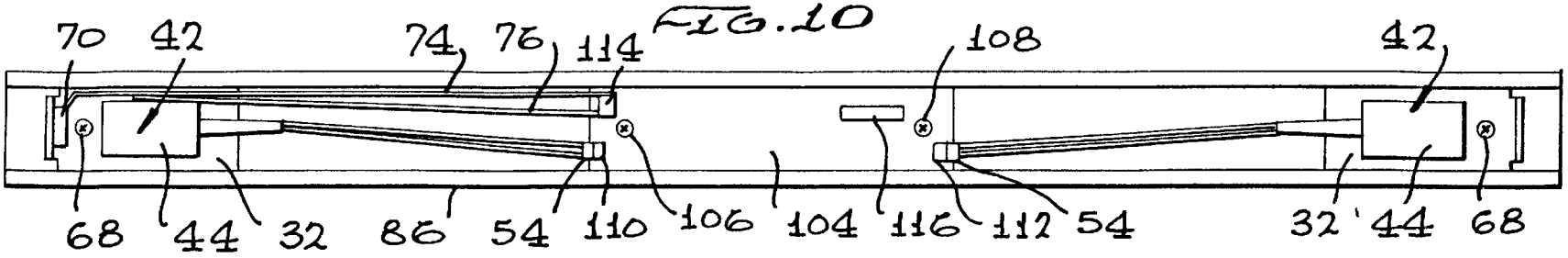
FIG. 10 is a plan view of a base rail having one of the electromechanical force transducer assemblies illustrated in FIG. 9 mounted therein adjacent each end thereof, and also showing a circuit board mounted therein intermediate the electromechanical force transducer assemblies.
Figure 11:
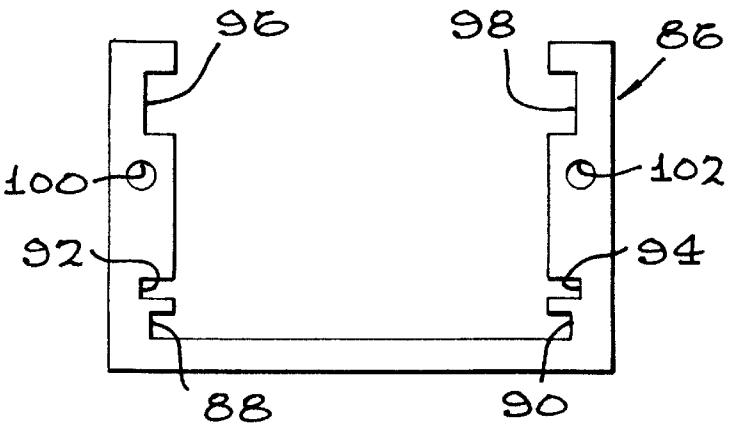
FIG. 11 is an end view of the base rail illustrated in FIG. 10, showing a plurality of pairs of opposed slots and two threaded apertures located therein.

Referring now to FIG. 10, the two electromechanical force transducer assemblies are illustrated as mounted in a base rail 86. The base rail 86 is constructed of heavy duty material, and in the preferred embodiment is a heavy duty aluminum extrusion. As shown in FIG. 11, the base rail 86 is essentially U-shaped in cross section, and has three pairs of longitudinally extending opposed slots located in the opposing sides thereof.

A first pair of opposed slots 88 and 90 extends the entire length of the base rail 86 adjacent the bottom of the interior of the base rail 86 (the base of the U). A second pair of opposed slots 92 and 94 extends the entire length of the base rail 86 just above the first pair of opposed slots 88 and 90. A third pair of opposed slots 96 and 98 extends the entire length of the base rail 86 just below the top edges of the base rail 86 (the tips of the legs of the U). The first pair of opposed slots 88 and 90 and the second pair of opposed slots 92 and 94 are relatively thin, and the third pair of opposed slots 96 and 98 is wider.

Located in the end of the base rail 86 illustrated in FIG. 11 are two threaded apertures 100 and 102, which are located on opposite sides of the base rail 86 (the legs of the U) below the third pair of opposed slots 96 and 98. Although they are not shown in the figures, a similar pair of threaded apertures are also located in the opposite end of the base rail 86. These threaded apertures are for use in attaching end caps (not illustrated in FIGS. 10 and 11) to the ends of the base rail 86.

A circuit board 104 is also illustrated in FIG. 10 as being mounted in the base rail 86. The edges of the circuit board 104 fit into (and are retained in) the second pair of opposed slots 92 and 94 in the base rail 86. Similarly, the base portions 32 of the base plates 30 (illustrated in FIG. 9) of the two electromechanical force transducer assemblies also fit into (and are retained in) the second pair of opposed slots 92 and 94 in the base rail 86. The screws 68 are screwed into the threaded aperture 36 (illustrated in FIG. 9) in the base portion 32 of the base plate 30 until they contact the bottom of the interior of the base rail 86, thereby retaining the electromechanical force transducer assemblies in place in the base rail 86.

In a similar manner, two screws 106 and 108 are screwed into threaded apertures in the circuit board 104 until they contact the bottom of the interior of the base rail 86, thereby retaining the circuit board 104 in place in the base rail 86 intermediate the two electromechanical force transducer assemblies.

Located on the circuit board 104 are two connectors 110 and 112 for connecting the circuit board 104 to the FSR's 46

(illustrated in FIG. 9) contained in the two electromechanical force transducer assemblies. Also located on the circuit board 104 is a connector 114 which is for connecting the circuit board 104 to the microswitch 70 contained on one of the electromechanical force transducer assemblies. The circuit board 104 also has a connector 116 which may be used to connect the circuit board 104 with a remote monitoring system (not illustrated herein), which is used to monitor and lock and unlock secured doors.

The connector 54 from the electromechanical force transducer assembly illustrated on the left end of the base rail 86 in FIG. 10 is plugged into the connector 110 on the circuit board 104. Similarly, the connector 54 from the electromechanical force transducer assembly illustrated on the right end of the base rail 86 in FIG. 10 is plugged into the connector 110 on the circuit board 104. The wires 74 and 76 from the microswitch 70 are electrically connected to the connector 114 on the circuit board 104.

Figure 12:
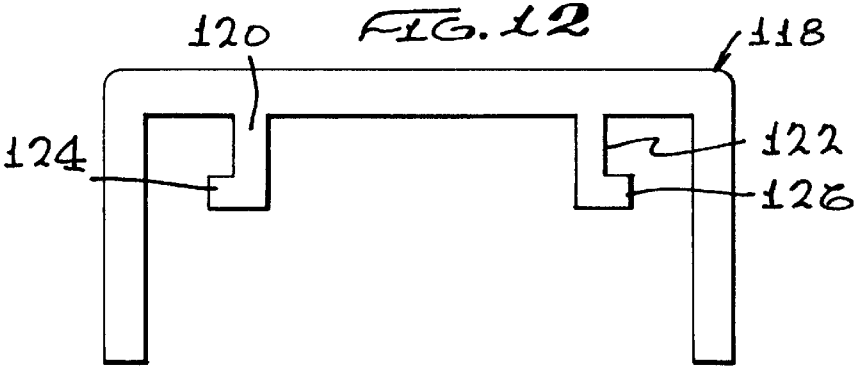
FIG. 12 is an end view of a touch pad cover for installation on the base rail illustrated in FIGS. 10 and 11, showing a pair of spaced-apart outwardly extending longitudinal projections located thereon.

Referring now to FIG. 12, the cross sectional appearance of a touch pad cover 118 is illustrated. The touch pad cover 118 is constructed of heavy duty material, and in the preferred embodiment is a heavy duty aluminum extrusion. The touch pad cover 118 is essentially U-shaped in cross section, and is adapted to fit (in inverted fashion) over the top of the base rail 86 (illustrated in FIGS. 10 and 11). As such, the touch pad cover 118 is approximately the same length as the base rail 86, and will fit over essentially the entire length of the base rail 86. The touch pad cover 118 has two spaced-apart longitudinally extending, downwardly extending projecting arms 120 and 122 extending from the base of the U.

Respectively located at the lowermost ends of the downwardly extending projecting arms 120 and 122 are two longitudinally extending, spaced-apart, outwardly extending longitudinal projections 124 and 126. The outwardly extending longitudinal projections 124 and 126 are arranged and configured to be received into the opposed slots 96 and 98 in the base rail 86 when the touch pad cover 118 is installed onto the base rail 86. The thicknesses of the outwardly extending longitudinal projections 124 and 126 in the touch pad cover 118 are less than the thicknesses of the opposed slots 96 and 98 in the base rail 86 to allow the touch pad cover 118 to move a short distance between first and second positions respectively away from and toward the interior of the base rail 86.

Figure 13:
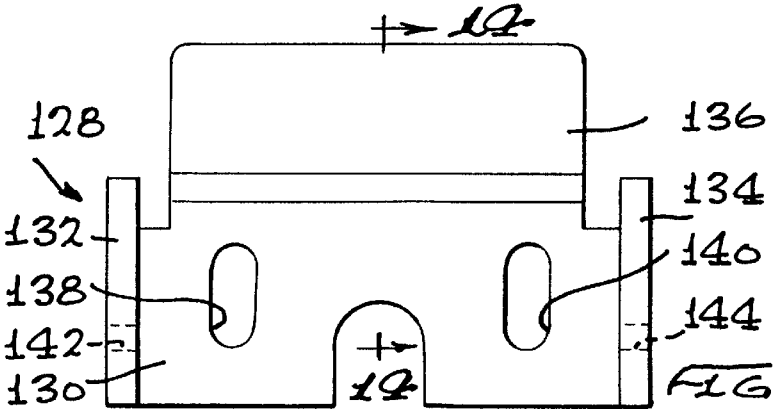
FIG. 13 is a top plan view of a mounting plate for securing one end of the base rail illustrated in FIGS. 10 and 11 to a door or another desired location.
Figure 14:
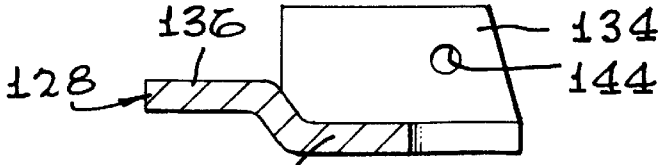
FIG. 14 is a cross sectional view of the mounting plate illustrated in FIG. 13.

Referring next to FIGS. 13 and 14, a mounting plate 128 which will be used to secure one end of the base rail illustrated in FIGS. 10 and 11 to a door or another desired location is shown. The mounting plate 128 has a base portion 130 which is of a generally rectangular configuration. Extending upwardly in orthogonal fashion from both of the shorter sides of the base portion 130 of the mounting plate 128 are two flanges 132 and 134, which are of a generally rectangular configuration. A tongue member 136 extends from one of the longer sides of the base portion 130 of the mounting plate 128, and is located slightly higher than the level of the base portion 130 of the mounting plate 128, as best shown in FIG. 14. The tongue member 136 is arranged and configured to fit into the opposed slots 88 and 90 in the base rail 86 (illustrated in FIG. 11).

Located in the base portion 130 of the mounting plate 128 are two oblong apertures 138 and 140 which will be used to mount the mounting plate 128 onto a door or another desired location (not illustrated herein ) using two screws (also not illustrated herein). Located in the flange 132 is a threaded aperture 142, and located in the flange 134 is a threaded aperture 144. The threaded apertures 142 and 144 will be used to mount an end cap (not illustrated in FIGS. 13 and 14 onto the mounting plate 128.

Referring now to FIGS. 15 through 18, an end cap 146 is illustrated, one of which end caps 146 will be installed onto each end of the base rail 86 (illustrated in FIG. 11). Each end cap 146 will enclose one end of the touch pad cover 118 (illustrated in FIG. 12), allowing the touch pad cover 118 to move freely between its first and second positions with respect to the base rail 86. The end cap 146 is hollow, and is open on the bottom side thereof (as best shown in FIG. 15) and on an adjacent side which will enclose the ends of the base rail 86 and the touch pad cover 118 (this side of the end cap 146 will be referred to as the mounting side and is best shown in FIG. 16).

Mounted onto the side of the end cap 146 opposite the mounting side are two mounting posts 148 and 150. The mounting posts 148 and 150 project into the interior of the end cap 146, extending approximately three-quarters of the way to the mounting side of the end cap 146. The mounting posts 148 and 150 contain apertures 152 and 154, respectively, which are recessed into the mounting posts 148 and 150, respectively. Located in the other two sides of the end cap 146 are two apertures 156 and 158, which are recessed into these sides and are located near to the bottom of the end cap 146.

Mounting screws (not illustrated herein) may be inserted into the apertures 152 and 154 in the mounting posts 148 and 150, respectively, and then into the threaded apertures 100 and 102, respectively, in the base rail 86 (illustrated in FIG. 11) to secure the end cap 146 to the base rail 86. Additional mounting screws (not illustrated herein) may be inserted into the apertures 156 and 158 and then into the threaded apertures 142 and 144, respectively, in the mounting plate 128 (illustrated in FIG. 13) to secure the end cap 146 to the mounting plate 128.

In the preferred embodiment, the end cap 146 is made of a hard, high impact molded plastic material, such as nylon or the like.

Referring next to FIG. 19 (in conjunction with FIG. 9), the touch pad cover 118 is illustrated mounted onto the base rail 86 with one of the electromechanical force transducer assemblies mounted within the base rail 86 also being shown. The touch pad cover 118 is shown in FIG. 19 as being in its first position with respect to the base rail 86—that is, the position in which it is located at its furthest position relatively away from the interior of the base rail 86. When the touch pad cover 118 is in this first position, note that the top side 44 of the cover member 42 of the electromechanical force transducer assembly is just in contact with a portion of the interior surface of the touch pad cover 118 located between the downwardly extending projecting arms 120 and 122.

In this first position, the first segment of resilient foam material 64 and the second segment of resilient foam material 66 (illustrated in FIG. 9) are not being compressed. It will be appreciated by those skilled in the art that when pressure is exerted on the touch pad cover 118 in a direction toward the base rail 86, causing the touch pad cover 118 to move from its first position toward its second position (the position in which it is located at its closest position to the interior of the base rail 86), pressure from the interior of the touch pad cover 118 will be exerted on the top side 44 of the cover member 42. Whenever the touch pad cover 118 exerts such pressure on the top side 44 of the cover member 42, the first segment of resilient foam material 64 and the second segment of resilient foam material 66 will be compressed, and pressure will be placed on the FSR 46 (illustrated in FIG. 9). The resistance of the FSR 46 will diminish in inverse proportion to the amount of force exerted upon it, thereby supplying a signal to the circuit board 104 (illustrated in FIG. 10).

Referring for a moment to FIG. 9, it will be appreciated by those skilled in the art that the construction of the cover member 42 will limit the amount of force which may be placed upon 46. When the first segment of resilient foam material 64 and the second segment of resilient foam material 66 are compressed to the maximum amount selected, the bottom of the cover member 42 will contact the top surface of the base portion 32 of the base plate 30. This mechanical contact will thereby limit the amount of force which may be placed on the FSR 46.

Referring again to FIG. 19, it will be appreciated that if the touch pad cover 118 is moved sufficiently in a direction from its first position toward its second position, the interior surface of the touch pad cover 118 will contact the actuator 72 of the microswitch 70, thereby tripping the microswitch 70. The dimensions of the door access bar of the present invention are designed so that the actuator 72 of the microswitch 70 will be tripped only upon the application of a force to the touch pad cover 118 which is well more than sufficient to cause the FSR 46 to drop its resistance sufficiently to cause the control circuitry on the circuit board 104 to cause the door (not illustrated herein) to be unlocked. Typically, the force which is required to cause the FSR 46 to thusly actuate is between five and fifteen pounds, and the force which is required to trip the actuator 72 of the microswitch 70 is approximately fifteen pounds or more. Significantly, it will be noted by those skilled in the art that the microswitch 70 works with the same motion (caused by the application of force onto the touch pad cover 118) which places compressive force on the two electromechanical force transducer assemblies.

Figure 20:
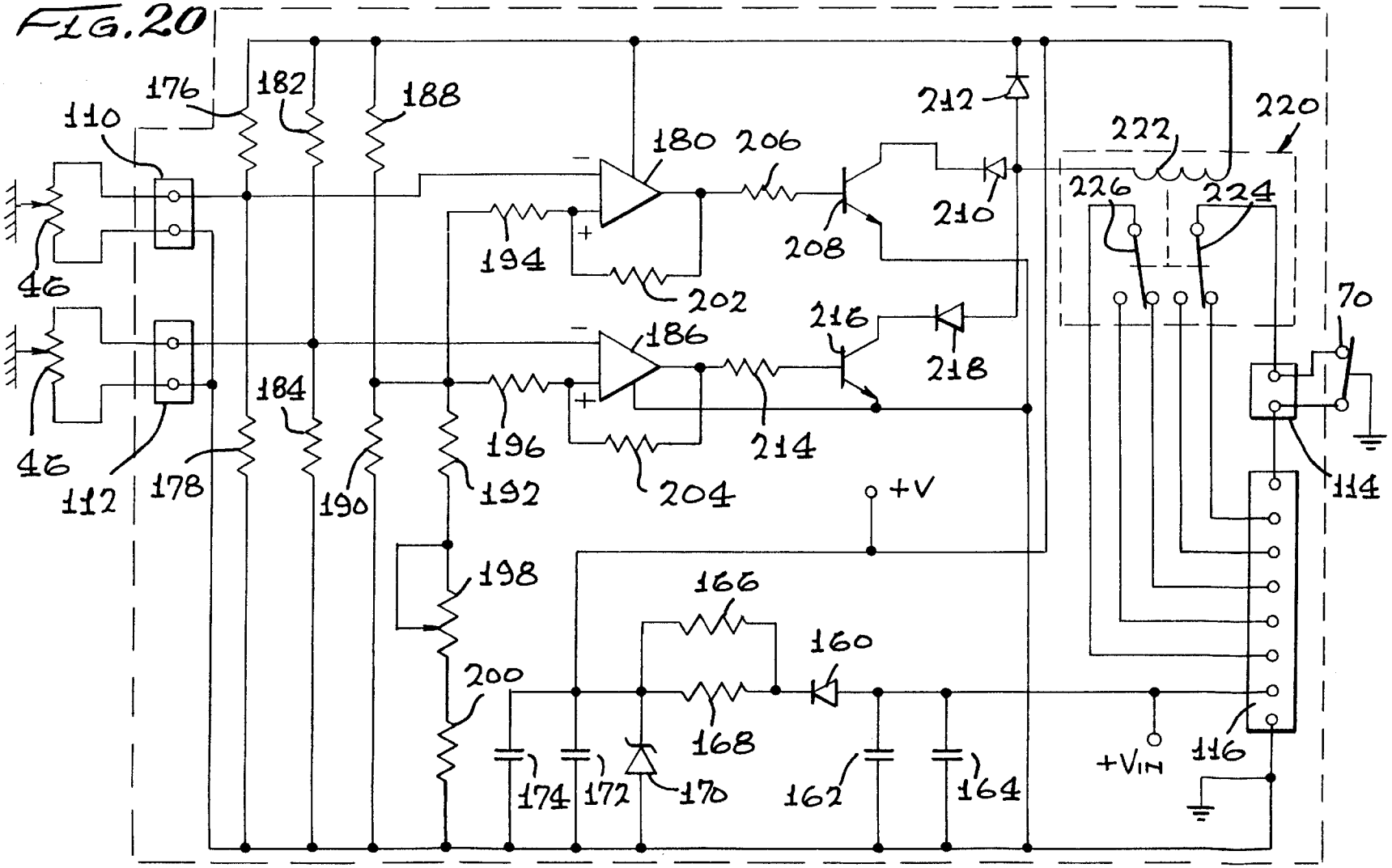
FIG. 20 is one possible electrical schematic for the circuit board illustrated in FIG. 10.

Referring finally to FIG. 20, an electrical schematic for an exemplary control circuit which may be used with the door access bar of the present invention is illustrated. The control circuit is contained on the circuit board 104, with the first FSR 46 being electrically connected to the connector 110, the second FSR 46 being electrically connected to the connector 112, and the microswitch 70 being electrically connected to the connector 114. The connectors 110, 112, and 114 each have two terminals, and are schematically illustrated in FIG. 20 as terminal blocks. Similarly, the connector 116 is illustrated as a terminal block having eight terminals. This terminal block nomenclature will be used in the following description of the electrical schematic of FIG. 20 for purposes of convenience.

The circuit illustrated in FIG. 20 contains power conditioning circuitry, which will be discussed first. Direct current power is supplied from a power source (not illustrated herein) to two terminals of the connector 116. One of these terminals is connected to the positive side of the power source and is labeled as $+V_{IN}$. The other of these terminals is connected to the negative side of the power source and is labeled as the circuit ground.

The terminal which is labeled as $+V_{IN}$ is connected to the anode of a diode 160, to one side of a capacitor 162, and to one side of a capacitor 164. The other side of the capacitor 162 and the other side of the capacitor 164 are connected to ground. The cathode of the diode 160 is connected to one side of a resistor 166 and to one side of a resistor 168. The other side of the resistor 166 and the other side of the resistor 168 are connected together and to the cathode of a Zener diode 170, to one side of a capacitor 172, and to one side of a capacitor 174, and this common point is the conditioned supply voltage which is labeled as +V. The anode of the Zener diode 170, the other side of the capacitor 172, and the other side of the capacitor 174 are connected to ground.

One of the terminals of the connector 110 (one side of the first FSR 46) is connected to ground, and the other terminal of the connector 110 (the other side of the first FSR 46) is connected to one side of a resistor 176, to one side of a resistor 178, and as the inverting input to a comparator 180. The other side of the resistor 176 is connected to +V, and the other side of the resistor 178 is connected to ground.

One of the terminals of the connector 112 (one side of the second FSR 46) is connected to ground, and the other terminal of the connector 112 (the other side of the second FSR 46) is connected to one side of a resistor 182, to one side of a resistor 184, and as the inverting input to a comparator 186. The other side of the resistor 182 is connected to +V, and the other side of the resistor 184 is connected to ground.

The comparators 180 and 186 are typically contained on a single integrated circuit (IC), and are connected to +V and to ground. In FIG. 20, only the comparator 180 is shown to be connected to +V, and only the comparator 186 is shown to be connected to ground. It will be understood by those skilled in the art that both of the comparators 180 and 186 are connected to both +V and to ground.

One side of a resistor 188, one side of a resistor 190, one side of a resistor 192, one side of a resistor 194, and one side of a resistor 196 are connected together. The other side of the resistor 188 is connected to +V, and the other side of the resistor 190 is connected to ground. The other side of the resistor 194 is connected as the noninverting input of the comparator 180, and the other side of the resistor 196 is connected as the noninverting input of the comparator 186.

The other side of the resistor 192 is connected to the center tap of a potentiometer 198. One side of a resistor 200 is connected to one side of the potentiometer 198, and the other side of the resistor 200 is connected to ground. The potentiometer 198 will be used to control how much pressure must be exerted on the FSR's 46 to cause the comparators 180 and 186 to change state, as will be described below following the description of the circuit illustrated in FIG. 20.

One side of a resistor 202 is connected to the noninverting input of the comparator 180, and the other side of the resistor 202 is connected to the output of the comparator 180. Similarly, one side of a resistor 204 is connected to the noninverting input of the comparator 186, and the other side of the resistor 204 is connected to the output of the comparator 186.

One side of a resistor 206 is connected to the output of the comparator 180, and the other side of the resistor 206 is connected to the base of an NPN transistor 208. The emitter of the transistor 208 is grounded, and the collector of the transistor 208 is connected to the cathode of a diode 210. The anode of the diode 210 is connected to the anode of a diode 212, and the cathode of the diode 212 is connected to +V .

One side of a resistor 214 is connected to the output of the comparator 186, and the other side of the resistor 214 is connected to the base of an NPN transistor 216. The emitter of the transistor 216 is grounded, and the collector of the transistor 216 is connected to the cathode of a diode 218. The anode of the diode 218 is connected to the anode of the diode 212.

A double pole, double throw relay 220 is mounted on the circuit board 104. The relay 220 has a coil 222 which is connected across the diode 212. The throw of a first switch 224 in the relay 220 is connected to one terminal of the connector 114 (which is connected to one side of the microswitch 70). The other terminal of the connector 114 (which is connected to the other side of the microswitch 70) is connected to a terminal in the connector 116.

The normally closed side of the first switch 224 in the relay 220 is connected to another terminal in the connector 116, and the normally open side of the first switch 224 in the relay 220 is connected to yet another terminal in the connector 116. The throw of a second switch 226 in the relay 220 is connected to still another terminal in the connector 116. The normally closed side of the second switch 226 in the relay 220 is connected to another terminal in the connector 116, and the normally open side of the second switch 226 in the relay 220 is connected to still another terminal in the connector 116.

The operation of the circuit illustrated in FIG. 20 may now be briefly described. By adjusting the potentiometer 198, a reference voltage is set which is supplied to the noninverting input of each of the comparators 180 and 186 (thus meaning that the comparators 180 and 186 operate as inverting comparators).

When force is applied to the first FSR 46, the resistance across the first FSR 46 drops. This causes the voltage which is applied to the inverting input of the comparator 180 to drop. When the voltage which is applied to the inverting input of the comparator 180 drops below the voltage which is applied to the noninverting input of the comparator 180, the comparator 180 will change from a low output to a high output. Whenever the output of the comparator 180 is high, the transistor 208 will be turned on, thereby energizing the coil 222 of the relay 220. Thus, when sufficient force is applied to the first FSR 46, the coil 222 of the relay 220 will be energized.

Similarly, when force is applied to the second FSR 46, the resistance across the second FSR 46 drops. This causes the voltage which is applied to the inverting input of the comparator 186 to drop. When the voltage which is applied to the inverting input of the comparator 186 drops below the voltage which is applied to the noninverting input of the comparator 186, the comparator 186 will change from a low output to a high output. Whenever the output of the comparator 186 is high, the transistor 218 will be turned on, thereby energizing the coil 222 of the relay 220. Thus, when sufficient force is applied to the second FSR 46, the coil 222 of the relay 220 will be energized.

It will thus be appreciated that whenever sufficient force is applied to either the first FSR 46 or to the second FSR 46, or to both the first FSR 46 and the second FSR 46, the coil 222 of the relay 220 will be energized. Typically, the potentiometer 198 is adjusted to require between five and fifteen pounds of pressure to be exerted on either the first FSR 46 or the second FSR 46, or on both the first FSR 46 and the second FSR 46, to cause the coil 222 of the relay 220 to be energized. By using the normally closed contact of the first switch 224 in the relay 220, the circuit to operate a magnet which locks a door (not illustrated herein) will be energized unless and until at lest the minimum preselected pressure is exerted on either the first FSR 46 or the second FSR 46, or on both the first FSR 46 and the second FSR 46.

The microswitch 70 is shown as a normally closed switch, which is inserted in series with the normally closed side of the first switch 224 in the relay 220. Thus, when sufficient pressure is exerted on the actuator 72 of the microswitch 70 (illustrated in FIG. 19), the microswitch 70 will open, interrupting the circuit used to power the magnet used to lock the door. The pressure required to operate the actuator 72 of the microswitch 70 is greater than the pressure required to operate the first and second FSR's 46. In the preferred embodiment, the pressure required to operate the actuator 72 of the microswitch 70 is at least approximately fifteen pounds.

It may therefore be appreciated from the above detailed description of the preferred embodiment of the present invention that it teaches a door access bar having an improved mounting arrangement for electromechanical force transducers through which mechanical contact by a user with the door access bar is translated into an electrical output which may be utilized to initiate the process of unlocking the door on which the door access bar is located. The door access bar of the present invention contains the electromechanical force transducers entirely within the door access bar itself, and not between the door access bar and its mounting mechanism, thereby obviating inappropriate force sensing problems associated with warping or sagging of the door the door access bar is mounted on. The door access bar of the present invention has redundant electromechanical force transducers to ensure that pressure exerted on the door access bar is reliably sensed, with either force sensor being sufficient to trigger operation of the door access bar to cause the door to be unlocked and/or opened.

The door access bar of the present invention requires only a slight degree of force and minimal movement of the door access bar to initiate the electrical output indicating a desire for access or egress, and the minimum amount of force required to initiate opening of the door is fully adjustable over an appreciable range. The door access bar of the present invention includes an emergency override switch which will operate to open the door even in the event that both of the electromechanical force transducers or the control circuitry were to fail. The emergency override switch is operated by the same motion exerted on the door access bar that normally causes the electromechanical force transducers to unlock and/or open the door. The door access bar of the present invention is both easy and quick to mount on any door or other desired location.

The door access bar of the present invention is of a construction which is both durable and long lasting, and which will require little or no maintenance to be provided by the user throughout its operating lifetime. The door access bar of the present invention is also of inexpensive construction to enhance its market appeal and to thereby afford it the broadest possible market. Finally, all of the aforesaid advantages and objectives of the apparatus of the door access bar of the present invention are achieved without incurring any substantial relative disadvantage.

Although an exemplary embodiment of the door access bar of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A pressure-actuated door access control device for controlling an electrically activated door control system for operating a door hingedly mounted in a door frame, said door access device comprising:

a base member said base member having first and second ends;

a first transducer mounted in said base member nearer to said first end of said base member than it is to said second end of said base member, said first transducer producing an electrical parameter, the value of which varies in response to pressure applied to said first transducer;

a second transducer mounted in said base member nearer to said second end of said base member than it is to said first end of said base member, said second transducer producing an electrical parameter, the value of which varies in response to pressure applied to said second transducer;

a switch mounted in said base member;

a touch pad member mounted on said base member and moveable between a first position relatively farther from said base member and a second position relatively closer to said base member, said touch pad member subjecting said first and second transducers to a compressive force when said touch pad member is urged from said first position toward said second position, said touch pad member actuating said switch when said touch pad member is urged from said first position toward said second position with a force which is at least a first predetermined amount; and a control circuit which will cause the electrically activated door control system to operate the door in a first manner when either or both of said first and second transducers is subjected to a second predetermined amount of compressive force, or when said switch is actuated.

2. A door access device as defined in claim 1, wherein said base member is hollow, and wherein said first transducer, said second transducer, and said switch are located inside said base member.

3. A door access device as defined in claim 1, additionally comprising:

first monitoring means for monitoring said electrical parameter produced by said first transducer and for providing a first output signal whenever said electrical parameter of said first transducer meets a first threshold, said first output signal being provided to the electrically activated control system to cause said electrically activated control system to operate the door in the first manner; and second monitoring means for monitoring said electrical parameter produced by said second transducer and for providing a second output signal whenever said electrical parameter of said second transducer meets said first threshold, said second output signal being provided to the electrically activated control system to cause said electrically activated control system to operate the door in the first manner.

4. A door access device as defined in claim 1, additionally comprising:

means for mounting said base member on the mounting surface.

5. A door access device as defined in claim 4, wherein said mounting means comprises:

a first mounting plate for placement at a first location on the mounting surface, said first mounting plate engaging said base member at said first end thereof to retain said first end of said base member in position on the mounting surface; and a second mounting plate for placement at a second location on the mounting surf ace, said second mounting plate engaging said base member at said second end thereof to retain said second end of said base member in position on the mounting surface.

6. A door access device as defined in claim 1, wherein said base member comprises:

first engaging means for engaging a portion of said touch pad member;

and wherein said touch pad member comprises:

second engaging means for engaging a portion of said first engaging means of said base member.

7. A door access device as defined in claim 6, wherein said base member and said touch pad member are brought into engagement by sliding said touch pad member longitudinally onto said base member with said second engaging means of said touch pad member sliding into said first engaging means of said base member.

8. A door access device as defined in claim 7, additionally comprising:

a first end cap for installation onto said first end of said base member; and a second end cap for installation onto said second end of said base member, said first and second end caps retaining said touch pad member in place on said base member.

9. A door access device as defined in claim 6, wherein said base member is essentially U-shaped in cross section, and wherein said touch pad member is essentially U-shaped in cross section and fits over the open end of said base member.

10. A door access device as defined in claim 9, wherein said base member and said touch pad member are both made of extruded aluminum.

11. A door access device as defined in claim 9, wherein said first engaging means comprises:

a pair of opposed slots located in said base member which extend the entire length of said U-shaped base member just below top edges of said base member which form the tops of the legs of the U;

and wherein said second engaging means comprises:

a pair of spaced-apart longitudinally extending, downwardly extending projecting arms extending from the potion of said U-shaped touch pad member forming the interior of the base of the U; and a pair of longitudinally extending, spaced-apart, outwardly extending longitudinal projections which are respectively located at the lowermost ends of said downwardly extending projecting arms, said outwardly extending longitudinal projections being arranged and configured to be received into said opposed slots in said base member when said touch pad member is installed onto said base member, the thicknesses of said outwardly extending longitudinal projections in said touch pad member being less than the thicknesses of said opposed slots in said base member to allow said touch pad member to move a short distance between said first and second positions respectively away from and toward the interior of said base member.

12. A door access device as defined in claim 1, wherein said first and second transducers each comprise:

a force sensing resistor, whereby said electrical parameters of said first and second transducers each comprise the resistance exhibited by said force sensing resistor, the resistance exhibited by said force sensing resistor varying depending on the amount of compressive force that said force sensing resistor is subjected to.

13. A door access device as defined in claim 12, wherein said first and second transducers each additionally comprise:

a first segment of resilient foam material located intermediate said force sensing resistor and said base member; and a second segment of resilient material located intermediate said force sensing resistor and said touch pad member.

14. A door access device as defined in claim 13, wherein said first and second transducers each additionally comprise:

a base plate mounted in said base member, said first segment of resilient foam material being located on a top surface of said base plate; and a box-like cover member mounted over said second segment of resilient foam material, said touch pad member being located adjacent a top side of said cover member, said cover member being spaced away from said base plate when said touch pad member is in said first position, said cover member moving toward said base plate as said touch pad member moves from said first position toward said second position due to compression of said first and second segments of resilient foam material.

15. A door access device as defined in claim 14, wherein said first and second transducers each additionally comprise:

a thin plate located intermediate said force sensing resistor and said first segment of resilient foam material; and a thin disc located intermediate said force sensing resistor and said second segment of resilient foam material.

16. A door access device as defined in claim 15, wherein said thin disc is made of resilient silicone rubber and functions as a spring.

17. A door access device as defined in claim 15, wherein said first and second transducers each additionally comprise:

a gasket member made of elastomeric material, said gasket member being of a generally rectangular configuration with a portion of the rectangular configuration of said gasket member being cut away to admit said force sensing resistor therein.

18. A door access device as defined in claim 15, wherein said switch is mounted on said base plate of one of said first and second transducers.

19. A door access device as defined in claim 15, wherein said U-shaped base member comprises:

a pair of opposed slots extending the entire length of said base member adjacent the bottom of the interior of the base member (the base of the U), wherein said base plate slides into said pair of opposed slots.

20. A door access device as defined in claim 19, wherein said first and second transducers each additionally comprise:

a screw which is installed into a threaded aperture in said base plate and which bears against said base member to retain said base plate in a fixed position within said base member.

21. A door access device as defined in claim 1, wherein said first predetermined amount of force is greater than said second predetermined amount of force.

22. A door access device as defined in claim 21, wherein said first predetermined amount of force is at least approximately fifteen pounds.

23. A door access device as defined in claim 21, wherein said second predetermined amount of force is adjustable.

24. A door access device as defined in claim 21, wherein said second predetermined amount of force is between approximately five and fifteen pounds.

25. A pressure-actuated door access control device for controlling an electrically activated door control system for operating a door hingedly mounted in a door frame, said door access device comprising:

a base member said base member having first and second ends;

a first transducer mounted in said base member nearer to said first end of said base member than it is to said second end of said base member, said first transducer producing an electrical parameter, the value of which varies in response to pressure applied to said first transducer;

a second transducer mounted in said base member nearer to said second end of said base member than it is to said first end of said base member, said second transducer producing an electrical parameter, the value of which varies in response to pressure applied to said second transducer;

a switch mounted in said base member;

a touch pad member mounted on said base member and moveable between a first position relatively farther from said base member and a second position relatively closer to said base member, said touch pad member subjecting said first and second transducers to a compressive force when said touch pad member is urged from said first position toward said second position, said touch pad member actuating said switch when said touch pad member is urged from said first position toward said second position with a force which is at least a first predetermined amount;

first and second end caps for installation onto said first and second end of said base member, respectively, said first and second end caps retaining said touch pad member in place on said base member;

monitoring means for monitoring said electrical parameters produced by said first and second transducers and for providing a first output signal whenever said electrical parameters of either of said first or second transducers, or of both of said first and second transducers, meet a first threshold, said first output signal being provided to the electrically activated control system to cause said electrically activated control system to operate the door in the first manner; and control means for causing the electrically activated door control system to operate the door in said first manner when said switch is actuated.

26. A pressure-actuated door access control device for controlling an electrically activated door control system for operating a door hingedly mounted in a door frame, said door access device comprising:

a base member a first pressure transducer mounted in said base member near a first end thereof;

a second pressure transducer mounted in said base member near a second end thereof;

a switch mounted in said base member;

a touch pad member mounted on said base member and moveable between a first position relatively farther from said base member and a second position relatively closer to said base member, said touch pad member subjecting said first and second pressure transducers to a compressive force when said touch pad member is urged from said first position toward said second position, said touch pad member actuating said switch when said touch pad member is urged from said first position toward said second position with a force which is at least a first predetermined amount; and a control circuit which will operate the door in a first manner when either or both of said first and second pressure transducers is subjected to a second predetermined amount of compressive force, or when said switch is actuated.

27. A method of controlling an electrically activated door control system for selectively, electrically locking and unlocking a door hingedly mounted in a door frame, said method comprising:

providing a base member said base member having first and second ends;

mounting a first transducer in said base member nearer to said first end of said base member than it is to said second end of said base member, said first transducer producing an electrical parameter, the value of which varies in response to pressure applied to said first transducer;

mounting a second transducer in said base member nearer to said second end of said base member than it is to said first end of said base member, said second transducer producing an electrical parameter, the value of which varies in response to pressure applied to said second transducer;

mounting a switch in said base member;

mounting a touch pad member on said base member in a manner whereby said touch pad member is moveable between a first position relatively farther from said base member and a second position relatively closer to said base member, said touch pad member subjecting said first and second transducers to a compressive force when said touch pad member is urged from said first position toward said second position, said touch pad member actuating said switch when said touch pad member is urged from said first position toward said second position with a force which is at least a first predetermined amount; and operating the door in a first manner with the electrically activated door control system when either or both of said first and second transducers is subjected to a second predetermined amount of compressive force, or when said switch is actuated.

28. A pressure-actuated control device for selectively providing a control signal, said control device comprising:

a base member a first pressure transducer mounted in said base member near a first end thereof;

a second pressure transducer mounted in said base member near a second end thereof;

a switch mounted in said base member;

a touch pad member mounted on said base member and moveable between a first position relatively farther from said base member and a second position relatively closer to said base member, said touch pad member subjecting said first and second pressure transducers to a compressive force when said touch pad member is urged from said first position toward said second position, said touch pad member actuating said switch when said touch pad member is urged from said first position toward said second position with a force which is at least a first predetermined amount; and a control circuit which will provide said control signal when either or both of said first and second pressure transducers is subjected to a second predetermined amount of compressive force which is less than said first predetermined amount of force, or when said switch is actuated.

29. A pressure-actuated switching device comprising:

a base member first and second pressure transducers mounted in said base member near opposite ends thereof;

a switch mounted in said base member;

a touch pad member mounted on said base member and manually moveable between a first position relatively farther from said base member and a second position relatively closer to said base member, wherein the single motion of exerting manual pressure on said touch pad member will: (a) subject said first and second pressure transducers to a compressive force, and (b) actuate said switch when manual force of at least a first predetermined amount is exerted on said touch pad member; and a control circuit which will switch from a first state to a second state when either: (a) at least one of said first and second pressure transducers is subjected to a second predetermined amount of compressive force less than said first predetermined amount of compressive force, or (b) when said switch is actuated.

* * * * *